US005146990A

United States Patent [19]

Ritter, Jr.

[11] Patent Number: 5,146,990

[45] Date of Patent: Sep. 15, 1992

[54] ANCHORING STRUCTURE FOR MARINE RISER ASSEMBLY

[75] Inventor: Paul B. Ritter, Jr., Slidell, La.

[73] Assignee: Shell Offshore Inc., Houston, Tex.

[21] Appl. No.: 693,870

[22] Filed: Apr. 30, 1991

[51] Int. Cl.[5] ..... E21B 43/013

[52] U.S. Cl. ..... 166/340; 166/341; 166/364; 166/365

[58] Field of Search ..... 166/338, 340, 341, 363, 166/364, 365

[56] References Cited

U.S. PATENT DOCUMENTS

| | | | |
|---|---|---|---|
| 3,168,143 | 2/1965 | Watkins | 166/66.5 |
| 3,256,936 | 6/1966 | Johnson et al. | 166/46 |
| 3,424,241 | 1/1969 | Triplett | 166/0.5 |
| 3,474,858 | 10/1969 | Gibson et al. | 166/0.5 |
| 3,563,042 | 2/1971 | Ryan | 61/46.5 |
| 3,782,460 | 1/1974 | Skinner | 166/0.5 |
| 4,423,982 | 1/1984 | Zaremba | 405/195 |
| 4,797,029 | 1/1989 | Cowan et al. | 405/170 |

FOREIGN PATENT DOCUMENTS

| | | | |
|---|---|---|---|
| 1601929 | 11/1981 | United Kingdom | 166/365 |

*Primary Examiner*—William P. Neuder

[57] ABSTRACT

An anchor system for temporarily anchoring the lower end of a lower marine riser package (LMRP) assembly, drilling riser, and drill string used in drilling subsea wells. The anchor system includes a dummy wellhead secured to the ocean floor and weight means stored in a dummy wellhead that can be connected to the end of the drill string in a manner that restrains the lateral movement of the LMRP assembly, drilling riser, and drill string.

6 Claims, 2 Drawing Sheets

ANCHORING STRUCTURE FOR MARINE RISER ASSEMBLY

BACKGROUND OF THE INVENTION

The present invention relates to the drilling of oil and gas wells and in particular, to an apparatus useful in drilling, completing and working over offshore wells.

The more accessible areas of the world that may contain hydrocarbon deposits have been explored and the search now extends out into deeper waters, i.e. those more than 1500 feet deep. The production of hydrocarbon deposits from these deeper waters requires specially designed production facilities and platforms. The most logical choice for a platform is what is referred to as a tension leg platform since it is more economical to build than a conventional bottom-supported platform. The economics result from the elimination of the steel structure that is required for supporting a production platform on the surface from the bottom in extremely deep waters.

If a tension leg platform is to be used for the production platform, it is more convenient and economical if the platform is also used for drilling the wells during the development of the production reservoir. While the platform can be used for drilling the production wells, it must incorporate features that were not required in bottom-supported platforms used in more shallow waters. The features required are those that would make provisions for riding out storm conditions which will cause the platform to move laterally on the surface of the water. In a conventional bottom-supported platform, the platform does not move laterally with respect to the subsurface wells in storm conditions. This reduces and in fact eliminates any lateral stress on the wellhead or production tubing coupling the platform to the wellhead. In the case of a tension leg platform since the platform freely floats on the surface, storm conditions can cause considerable lateral movement which will exert stresses onto the subsea well equipment which are not present in prior systems.

The stresses exerted on the wellhead equipment and foundation during storm (high offset) conditions are particularly high during drilling operations when the equipment extending from the platform to the wellheads exerts high bending, axial and laterial loads to the marine wellhead system. In conventional drilling operations the subsea equipment would include a blowout preventer assembly (BOP) plus a lower marine riser package (LMRP) assembly all of which would be connected to the surface through the marine riser. The drill string would then extend through the riser and the subsea wellhead equipment. The total height of the blowout preventers plus the marine riser package exceeds the normal height of wellhead equipment. In addition, the total weight of the equipment is considerably more than a conventional production wellhead. Likewise, the marine riser is considerably larger than normal production tubing and thus weighs more and exerts more force on the wellhead equipment if the platform moves laterally under storm conditions. All of these factors result in a considerably increased lateral load on the subsea wellhead during storm conditions.

An obvious means for reducing the load on the subsea wellhead during storm conditions is to remove the equipment from the wellhead that is tied-back and tensioned from the surface vessel to reduce the load on the wellhead. It is possible to remove the LMRP assembly and the riser and drill string from the wellhead assembly leaving only the blowout preventers which can be closed to safely secure the subsea well. Once the marine riser and the LMRP assembly is removed from the wellhead it will present a problem since it must either be raised to the surface or it must be constrained to ensure that it does not cause damage to the tension legs or well production risers of the platform or to other apparatus on the floor of the ocean. It can be readily appreciated that the long marine riser with the LMRP assembly attached to its lower end extending down to near the ocean floor provides an object which will swing with considerable force as storm conditions laterally move the platform.

Normally, it would be desirable to bring the riser and LMRP to the surface. However, it requires considerable time to disassemble the individual sections of the riser pipe and store them on the platform. Further, storage facilities for the riser pipe may not be normally present or quickly and easily accessible. Thus, it may be preferable that means be provided for securing the riser pipe and LMRP assembly to the ocean floor so that storm conditions will not cause it to move or swing around and cause damage to either the tension legs of the platform or to subsea equipment.

SUMMARY OF THE INVENTION

The present invention solves the above problems by providing an anchoring means for securely anchoring the riser pipe and LMRP assembly to the ocean floor when it is removed from a wellhead. The anchoring means, while anchoring the conductor pipe to the ocean floor, provides for limited lateral movement of the riser and LMRP so that undue stresses will not be placed on the riser pipe, LMRP assembly and subsea wellhead during storm conditions. The invention utilizes the drill pipe which passes through the riser pipe to engage an anchoring means which is permanently located on the ocean floor. Once engaged, the drill pipe and riser pipe and LMRP can be raised a sufficient height from the ocean floor to prevent interference with any of the wellhead equipment disposed on the ocean floor or the potentially sloping seabed itself. Even though the riser pipe is raised above the ocean floor, the anchoring means restrains its lateral movement.

The anchoring means consists of what is, in effect, a dummy wellhead that is located on the ocean floor. An elongated weight means is disposed in the dummy wellhead and has provisions for engaging the end of the drill string. When it is necessary to anchor the riser and LMRP assembly, the drill string can be extended through the riser and LMRP assembly and guided into the dummy wellhead (riser anchor structure) to engage the fastening means. Once the drill pipe is engaged with the fastening means it is retracted and pulls the elongated weight means from the dummy wellhead (RAS). The elongated weight means will extend up from the dummy wellhead and has sufficient flexibility to allow the riser and LMRP assembly to move and yet contains sufficient weight to restrain its movements within safe limits.

BRIEF DESCRIPTION OF THE DRAWINGS

The present invention will be more easily understood from the following detailed description of a preferred embodiment when taken in conjunction with the attached drawings in which.

DESCRIPTION OF THE PREFERRED EMBODIMENT

Figure 1:
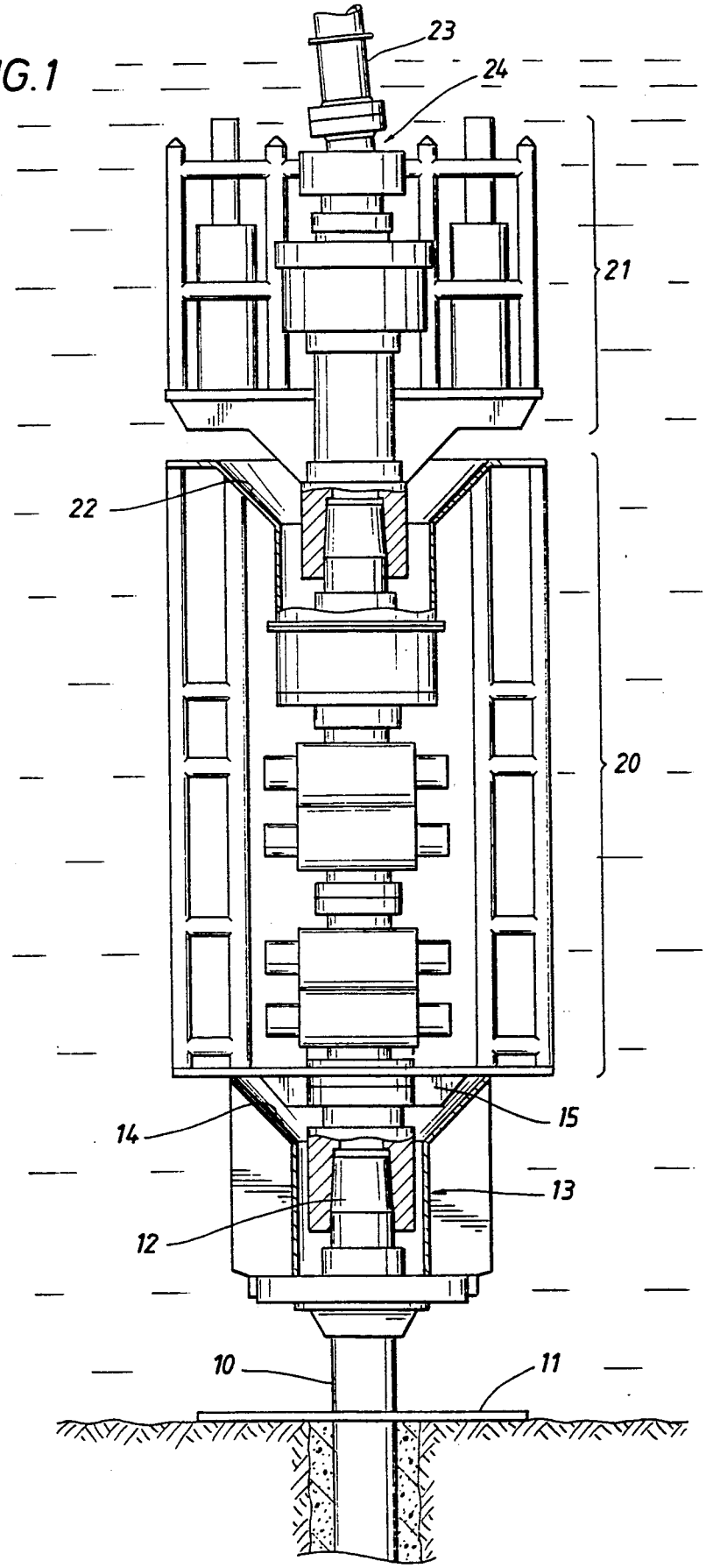
FIG. 1 is an elevation view of a typical subsea wellhead assembly during drilling operations.

Referring to FIG. 1, there is shown the subsea wellhead assembly used during conventional drilling operations. The assembly consists of suitable casing 10 which is secured to a mud mat 11 and extends into the floor of the ocean. The casing 10 can be driven, drilled, or jetted into the ocean floor and cemented in place by conventional means. A remotely operated subsea wellhead 12 is secured to the top of the casing 10. Positioned above the wellhead assembly is a guide means 13 that may comprise a series of upright support plates which have inclined surfaces 14 formed on their upper ends. A funnel-shaped plate member is secured to the upper ends of the upright plates to form the guide surface. The use of a series of plates provides an open structure through which debris can easily pass. The guide means serves to guide the conical end 15 of wellhead assembly into position over the casing as shown in the drawing. The wellhead assembly consists of a blowout preventer stack (BOP) 20 and a lower marine riser package (LMRP) assembly 21. The blowout preventer stack may also include a guide means 22 at its upper end for guiding the LMRP assembly package 21 into position over the well.

The drilling riser 23 extends from the top of the LMRP assembly to the surface and is used for conducting drilling mud returns from the well to the surface as the well is drilled. A suitable flexible joint 24 is included in the marine conductor to allow angular movement of the riser with respect to the wellhead as shown in the drawing.

Figure 2:
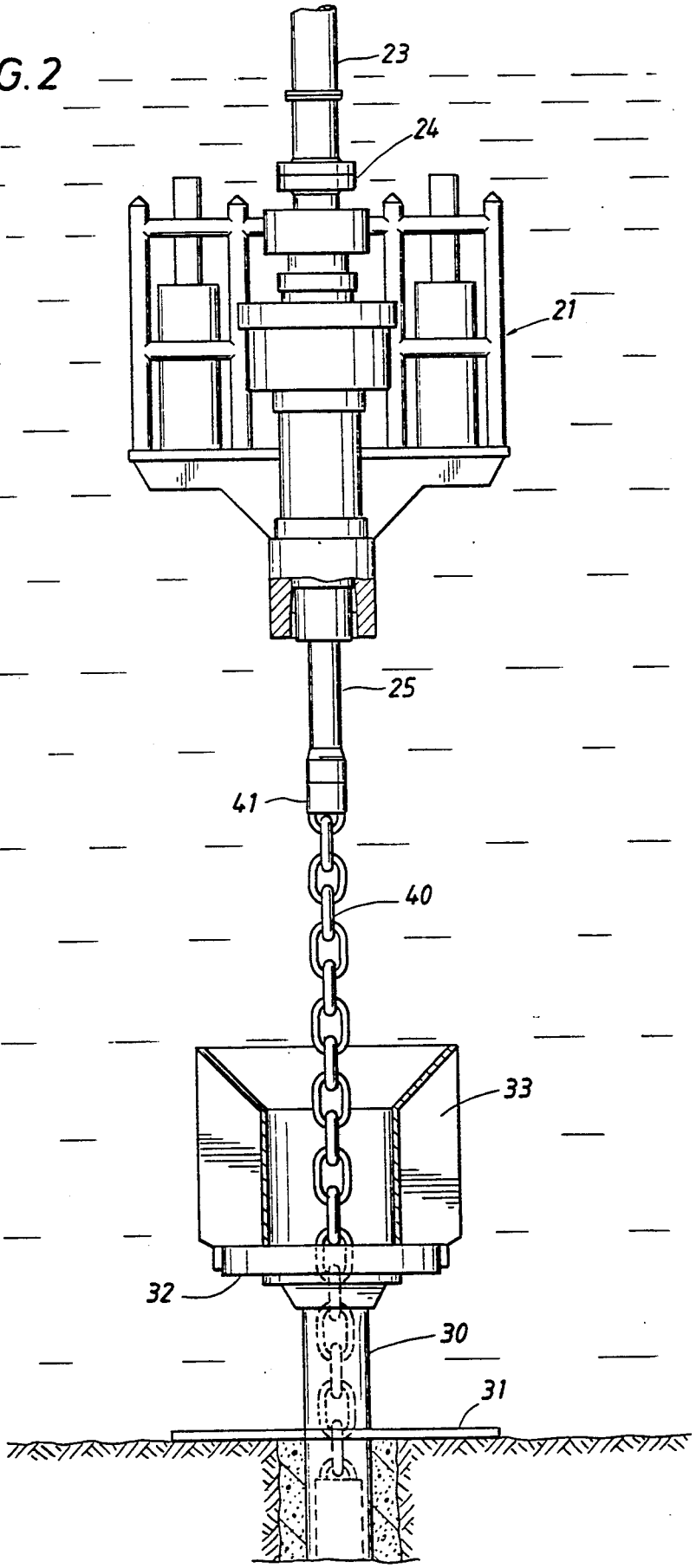
FIG. 2 is an elevation view of the present invention showing the riser and LMRP assembly anchored by means of the RAS.

Referring now to FIG. 2, there is shown the LMRP assembly 21 removed from the BOP and hanging at the lower end of the drilling riser 23. A drill string 25 is shown extending below the lower end of the marine riser assembly.

The anchoring means of the present invention includes an anchor assembly 30 which is attached to a mud mat 31 on the ocean floor. The anchor assembly is similar to a conventional wellhead and includes casing which extends into the ocean floor that is driven or jetted in place and then cemented in the same manner as the well casing 10. The anchor assembly also includes a mandrel 32 so that conventional wellhead equipment may be attached to the anchor assembly if desired. Likewise, a guide means 33 is attached to the top of the assembly to guide equipment onto the anchor assembly mandrel when desired.

The anchor assembly includes sufficient casing which is installed into the ocean bottom to firmly secure it in place. In effect, the anchor assembly is a dummy wellhead that includes most of the features of a producing well but does not extend into the producing formation. Positioned within the casing or tubular portion of the anchor assembly is an elongated weight or anchor means 40. As shown, the elongated weight means is a conventional chain member although other means may be used. For example, a series of weighted members that are flexibly joined could be used in place of the chain. The main requirement for the elongated weight means is that it provide sufficient weight to restrain or restrict to an acceptable radius of lateral movement the riser and LMRP assembly and be capable of being stored within the dummy wellhead when not in use.

Secured to the upper end of the elongated weight means is an adaptor collet member or mandrel 41 which can engage the lower end of the drill string. This mandrel may have a conventional tool joint having internal threads so that the drill string can be threaded into the mandrel to securely attach the drill string to the elongated weight 40. The outer surface of the mandrel is provided with surface configuration that matches the blowout preventer. This allows the LMRP to be secured to the mandrel and the drill string removed from the mandrel and withdrawn from the riser if desired. Other attachment means may be used. For example, a collet that will engage a conventional rotary drill bit could be used. Likewise, slots or cam actuated locking means could be used. All of these means are well known to those skilled in the art.

When it is desired to anchor the subsea LMRP assembly and the riser in the face of quickly approaching severe storm conditions, the well is secured and the LMRP assembly removed from the wellhead shown in FIG. 1. After removal of the LMRP assembly, the riser pipe is raised on the platform to raise the assembly off the ocean floor as shown in FIG. 2. The subsea assembly is then moved laterally to the anchor assembly 30 by rig movement. Once the subsea assembly is in position over the RAS assembly the drill string can be lowered through the riser and mated with the RAS mandrel 41. Once the drill string is mated with the mandrel, the drill string and conductor pipe can be raised a sufficient height so that any lateral movement caused by the storm conditions will not cause either to strike any of the subsea equipment. As the drill pipe is raised, it will remove a portion of the elongated weight means from the anchor system. A sufficient quantity of the elongated weight means should be removed to provide a biasing force on the end of the conductor, subsea LMRP assembly and drill string to limit their lateral movement during storm conditions. While the assembly is restrained by the weight means, there is still sufficient freedom of motion to prevent any physical damage to the equipment as a result of excessive loads placed on the equipment by excessive restraining forces.

From the above description of operation, it can be seen that the present invention provides a means which is easily operable to anchor the marine riser and subsea LMRP assembly in position so that it can ride out severe storm conditions. The anchoring system does not fixably anchor the equipment to the ocean floor but rather restrains its movement so that it does not strike other subsea facilities and damage them during storm conditions. This prevents the development of excessive stresses in the riser or LMRP assembly as a result of angular movement of the riser or LMRP assembly.

What is claimed is:

1. An anchor system for anchoring the lower end of a marine riser, lower marine riser package (LMRP) assembly and drill string to the ocean floor, comprising:

an anchor assembly secured to the ocean floor, said assembly including a tubular member extending into the ocean bottom;

a guide means, said guide means being positioned at the top of the tubular member to guide a member lowered from the surface of the ocean into said tubular member;

an elongated weight means disposed in said tubular member, said weight means being flexible and having sufficient length to extend above the top of the tubular member; and a connecting means, said connecting means being coupled to one end of the elongated weight means and adapted to be coupled to an elongated member that extends through said LMRP assembly and riser and can be secured to said connecting means.

2. The anchor system of claim 1 wherein said anchor assembly comprises a wellhead and casing assembly that is disposed in the ocean floor.

3. The anchor system of claim 1 wherein said elongated weight means comprises a series of individual weights that are connected together by flexible means to form said elongated weight means.

4. The anchor system of claim 3 wherein said elongated weight means comprises a chain.

5. The anchor system of claim 3 wherein said elongated weight means comprises a flexible member and a clump weight secured to its lower end.

6. The anchor system of claim 1 wherein said anchor assembly comprises a dummy wellhead.

* * * * *